United States Patent [19]

Dob et al.

[11] 4,453,152

[45] Jun. 5, 1984

[54] SEWING MACHINE CONTROL

[75] Inventors: Allan M. Dob, Clifton; Richard Mead, Whippany; Terry L. Wilson, Denville, all of N.J.

[73] Assignee: The Singer Company, Stamford, Conn.

[21] Appl. No.: 456,875

[22] Filed: Jan. 10, 1983

[51] Int. Cl.[3] ..... H01C 10/00

[52] U.S. Cl. ..... 338/197; 338/134; 338/172; 338/200

[58] Field of Search ..... 338/134, 197, 172, 198, 338/179, 200, 201

[56] References Cited

U.S. PATENT DOCUMENTS

| | | | |
|---|---|---|---|
| 1,877,739 | 9/1932 | Schneider | 338/134 |
| 2,258,690 | 10/1941 | Rubinstein | 338/198 |
| 2,765,384 | 10/1956 | Arisman | 338/172 X |
| 3,187,118 | 6/1965 | Butler et al. | 338/134 X |
| 3,312,925 | 4/1967 | Frantz | 338/198 X |
| 3,602,868 | 8/1971 | Lybrook | 338/198 |
| 3,643,199 | 2/1972 | Tanaka | 338/172 |
| 3,748,627 | 7/1973 | Zdanys, Jr. | 338/172 |
| 3,924,220 | 12/1975 | Matsui et al. | 338/172 |
| 3,927,276 | 12/1975 | Lipp | 338/172 X |
| 4,090,167 | 5/1978 | Walker et al. | 338/172 |

*Primary Examiner*—C. L. Albritton

*Attorney, Agent, or Firm*—William V. Ebs; Robert E. Smith; Edward L. Bell

[57] ABSTRACT

A control for a sewing machine is provided with a turnable outer knob for operating a potentiometer, and a slidable inner knob within the outer knob for moving a contact member to connect conductive paths on a printed circuit board which supports both the potentiometer and contact members.

2 Claims, 4 Drawing Figures

SEWING MACHINE CONTROL

BACKGROUND OF THE INVENTION

1. Field of the Invention

The invention relates to controls for sewing machines and more particularly, to controls therefor capable of performing a dual function.

2. Description of the Prior Art

It is known for sewing machines with electronic pattern control means to be provided with overriding controls enabling an operator to vary bight and stitch length. In such machines, a potentiometer has been used as an overriding control to provide a bight or stitch length signal. Once such a potentiometer had been switched into the circuit and so rendered effective for use, it could be turned off only by the operator selecting a new pattern for sewing with a control located at a location remote from the overriding control.

It is a prime object of the present invention to provide an improved control of the kind described which can be activated or deactivated, and can be operated to provide a selected output control signal, all at the same location.

It is another object of the invention to provide an improved sewing machine control including both an angularly adjustable signal modulating control and an on-off push button control.

Other objects and advantages of the invention will become apparent during a reading of the specification taken in connection with the accompanying drawings.

SUMMARY OF THE INVENTION

A control according to the invention includes a movable contact member between conductive paths on a printed circuit board. The contact member is biased into a position wherein the conductive paths on the board are disconnected. A potentiometer mounted on the printed circuit board is operable by an outer control knob on an input shaft. An inner control knob slidable within the outer knob includes means extending through the outer knob to engage and move the movable contact member so as to connect the said conductive paths on the board.

DESCRIPTION OF THE PREFERRED EMBODIMENT

Figure 1:
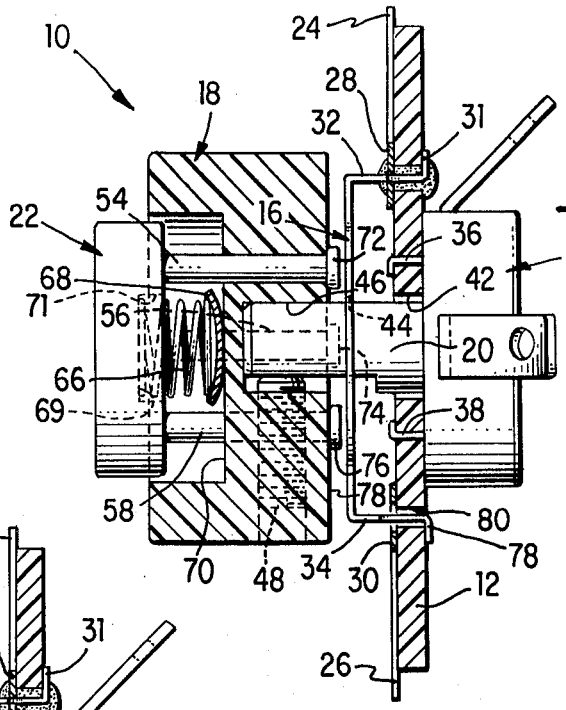
FIGS. 1 and 2 are similar vertical longitudinal sectional views showing the control of the invention in different operative positions.
Figure 4:
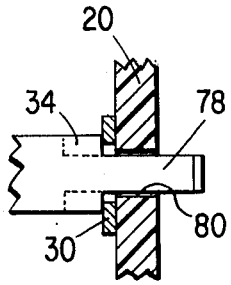
FIG. 4 is a sectional view taken on the plane of the line 4—4 of FIG. 2.

Referring to the drawings, reference character 10 designates a control according to the invention particularly suited for use in a sewing machine with electronic pattern control means but not necessarily limited thereto. The control includes a printed circuit board 12, a potentiometer 14 which is mounted on the board, a movable spring contact member 16, an outer knob 18 which is mounted on an input shaft 20 for the potentiometer, and an inner knob 22 which is axially slidable within the outer knob.

Portions of two electrically conductive paths 24 and 26 with ring-like end terminals 28 and 30, respectively, may be seen on board 12. Contact member 16 spans the distance between the terminals and has the end portion 31 of a tab 32 at one end soldered to end terminal 28. A tab 34 at the other end of member 16 is free to engage and disengage terminal 30. Potentiometer 14 is mounted on the opposite side of the printed circuit board from conductive paths 24 and 26, the potentiometer being secured to the board with bent down tabs 36 and 38. Shaft 20 extends from the potentiometer through an opening 42 in the board as well as through an opening 44 in contact member 16, and then into a bottom opening 46 in the outer knob 18 where the knob is secured to the free end portion of the shaft as with a set screw 48.

Figure 2:
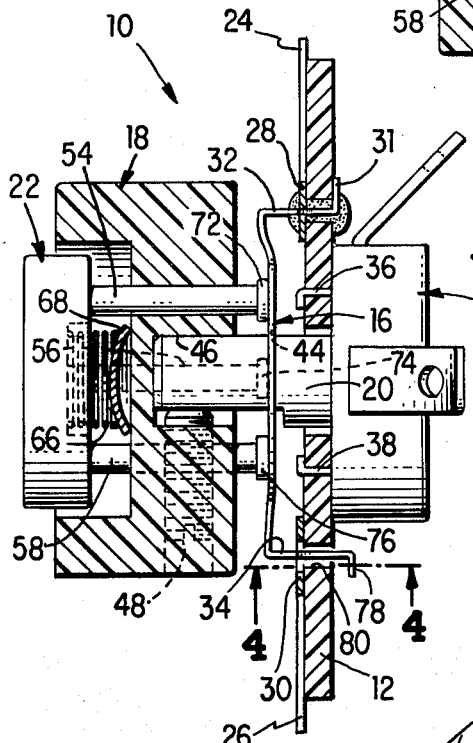
Figure 3:
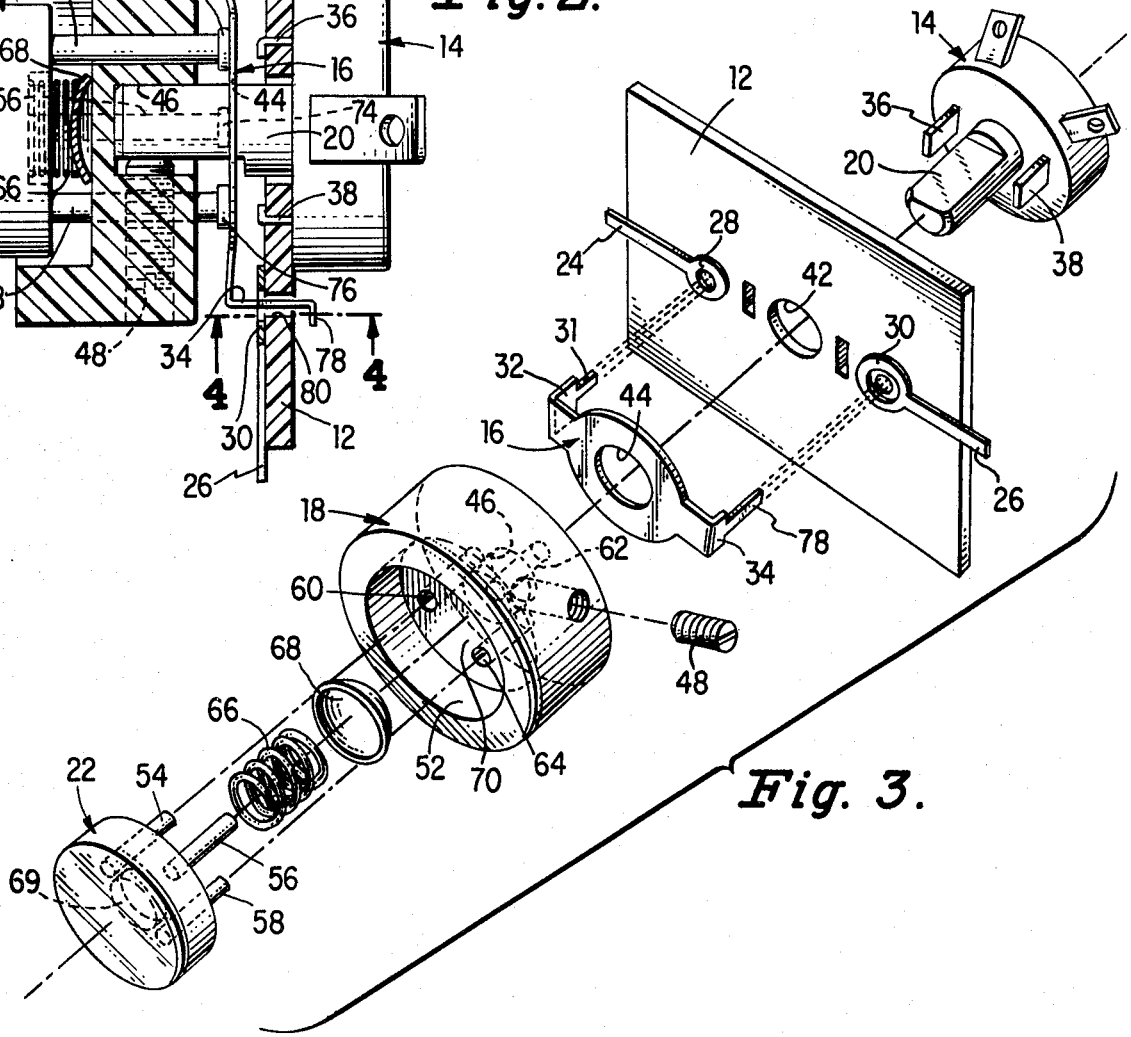
FIG. 3 is an exploded perspective view of the control.

Knob 18 is formed with an inner cylindrical surface 52 to receive inner knob 22. The inner knob 22 which is slidable within outer knob 18 includes a plurality of staked pins 54, 56 and 58 which extend through holes 60, 62 and 64, respectively, in the outer knob 18 to locate the free ends opposite spring contact member 16. A coil spring 66 and flexible snap disc 68 are provided between a wall surface 70 on outer knob 18 and the bottom 69 of a recess 71 in inner knob 22. Spring 66 is compressed within outer knob 18 and acts axially outward on the inner knob which is nevertheless retained within the outer knob by enlarged end portions 72, 74 and 76, formed on pins 54, 56 and 58 (after the inner and outer knobs have been assembled) to define a normal unactuated position for the inner knob. The snap disc 68 is located between coil spring 66 and wall surface 70, and is normally unflexed (FIG. 1). The disc is snapped over center when the inner knob is pushed (FIG. 2), and serves at such time in conjunction with the spring to provide tactile feel to the inner knob.

An operator can turn outer knob 18 to position shaft 20, and thereby select what the resistance for the potentionmeter shall be at any particular time. If knob 22 is pushed inwardly in outer knob 18 against the bias of spring 66, pins 54, 56 and 58 are caused to act against contact member 16 and flex the contact member until tab 34 guided by a projection 78 thereon extending through a hole 80 in board 12 contacts terminal 30 to connect conductive paths 24 and 26. When button 22 is released, spring 66 returns the inner button 22 to its normal position defined by the engagement of the englarged end portions 72, 74 and 76 of the pins 54, 56 and 58 with the bottom surface 78 of knob 18 about holes 60, 62 and 64. Disc 68 is snapped back over center into an unflexed state, and contact member 16 by reason of its natural resiliency is moved to cause tab 34 to disengage terminal 30 and so disconnect conductive paths 24 and 26.

With suitable circuitry, not shown herein because not part of the present invention, the described control can be used in an electronic sewing machine to switch the potentiometer 14 into control circuitry as with one push of inner knob 22, and to switch the potentiometer out of the circuit as with a subsequent push of knob 22. Once the potentiometer has been switched into the circuit and so rendered effective for control purposes, an operator can cause the potentiometer to provide a bight or stitch length control signal by suitably positioning knob 18.

It is to be understood that the present disclosure relates to a preferred embodiment of the invention which is for purposes of illustration only and is not to be construed as limiting the invention. Numerous alterations and modifications will suggest themselves to those skilled in the art, and all such alterations and modifications which do not depart from the spirit and scope of the invention are intended to be included within the scope of the appended claims.

We claim:

1. A control for a sewing machine including a printed circuit board, a movable contact member between conductive paths on the board biased into a position wherein the paths are disconnected at said member, a potentiometer mounted on the board, an input shaft for the ptentiometer, an outer control knob on the shaft for turning the shaft to modulate operation of the potentiometer, an inner control knob within the outer knob including means extending through the outer knob to engage and move said movable contact member so as to connect the said conductive paths on the board, and a spring and a snap disc within the outer knob responsive to inward movement of the inner knob for providing tactile feel to the inner knob.

2. A control for a sewing machine including a printed circuit board, a movable contact member between conductive paths on the board biased into a position wherein the paths are disconnected at said member, a potentiometer mounted on the board, an input shaft for the potentiometer, an outer control knob on the shaft for turning the shaft to modulate operation of the potentiometer, and an inner control knob within the outer knob including pins affixed to the inner knob and extending through the outer knob to engage and move said movable contact member so as to connect the said conductive paths on the board.

* * * * *